US005771209A

United States Patent [19]

*Mock et al.

[11] Patent Number: 5,771,209

[45] Date of Patent: Jun. 23, 1998

[54] WRIST WATCH

[75] Inventors: Elmar Mock, Biel; Matthias Hell, Bern, both of Switzerland

[73] Assignee: Createc Patent Holding, S.A., Luxembourg, Luxembourg

[ * ] Notice: The terminal 7 months of this patent has been disclaimed.

[21] Appl. No.: 307,738

[22] PCT Filed: Mar. 25, 1993

[86] PCT No.: PCT/EP93/00733

§ 371 Date: Nov. 30, 1994

§ 102(e) Date: Nov. 30, 1994

[87] PCT Pub. No.: WO93/19403

PCT Pub. Date: Sep. 30, 1993

[30] Foreign Application Priority Data

| | | | |
|---|---|---|---|
| Mar. 26, 1992 | [CH] | Switzerland | 960/92 |
| Jul. 6, 1992 | [CH] | Switzerland | 2122/92 |
| Jul. 24, 1992 | [CH] | Switzerland | 2353/92 |
| Feb. 23, 1993 | [CH] | Switzerland | 554/93 |

[51] Int. Cl.[6] ..... G04B 5/02; G04B 37/00

[52] U.S. Cl. ..... 368/281; 368/282; 368/294

[58] Field of Search ..... 368/76, 80, 88, 368/276, 281, 282, 294, 295, 299, 300

[56] References Cited

U.S. PATENT DOCUMENTS

| | | | |
|---|---|---|---|
| 1,752,128 | 3/1930 | Utter . | |
| 3,545,198 | 12/1970 | Loftus . | |
| 4,561,077 | 12/1985 | Mock et al. | 368/282 |
| 4,620,798 | 11/1986 | Scarinzi | 368/276 |
| 4,825,427 | 4/1989 | Wollman . | |
| 4,958,334 | 9/1990 | Grosjean | 368/282 |
| 5,272,683 | 12/1993 | Jackl | 368/282 |

FOREIGN PATENT DOCUMENTS

| | | | |
|---|---|---|---|
| 221233 | 5/1987 | European Pat. Off. . | |
| 469950 | 2/1992 | European Pat. Off. . | |
| 449286 | 8/1949 | Italy | 368/282 |
| 53-22370 | 6/1978 | Japan . | |
| 260129 | 7/1949 | Switzerland . | |
| 591109 | 12/1976 | Switzerland | 368/282 |
| 654713 | 3/1986 | Switzerland . | |

*Primary Examiner*—Vit W. Miska
*Attorney, Agent, or Firm*—Walter C. Farley

[57] ABSTRACT

The wrist watch according to the invention has a strap or bracelet (8) and a case, formed from three case parts (upper part or cover glass 5, middle part or dial, lower part or bottom 3) and in which is placed a clockwork with time indicating means, particularly hands, and has standardized connecting areas (9) in which the bracelet (8) and at least two of the case parts are interconnected or interconnectable. The connecting areas (9) are e.g. constructed as hinges and during assembly serve as orientation aids for the orientation of the individual parts with one another and as application and orientation points for the orientation and assembly tools, as well as as definitive or temporary connections between the case parts and the bracelet. Shape-differing watch models having the same, standardized connecting areas, can be assembled using a substantially identical assembly procedure and tools, which leads to a faster model change procedure.

17 Claims, 10 Drawing Sheets

Figure 1A:
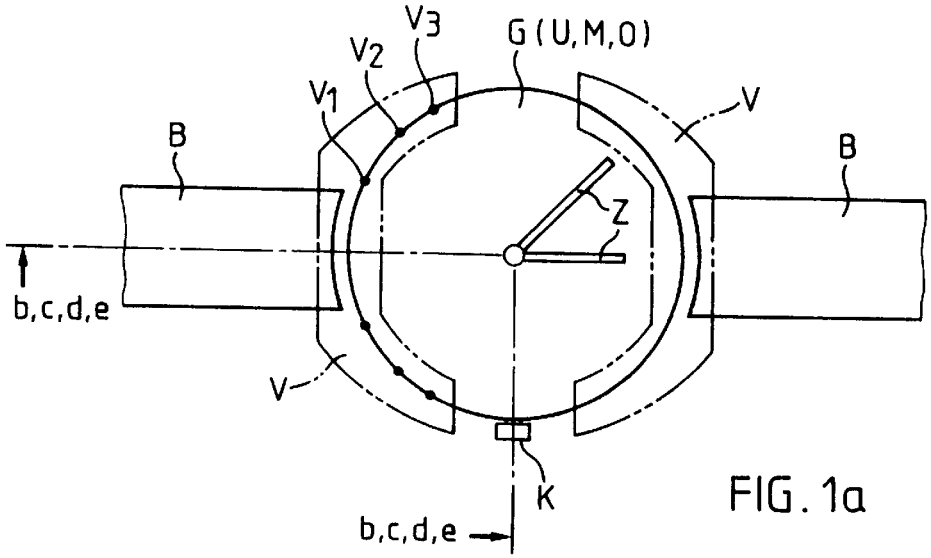

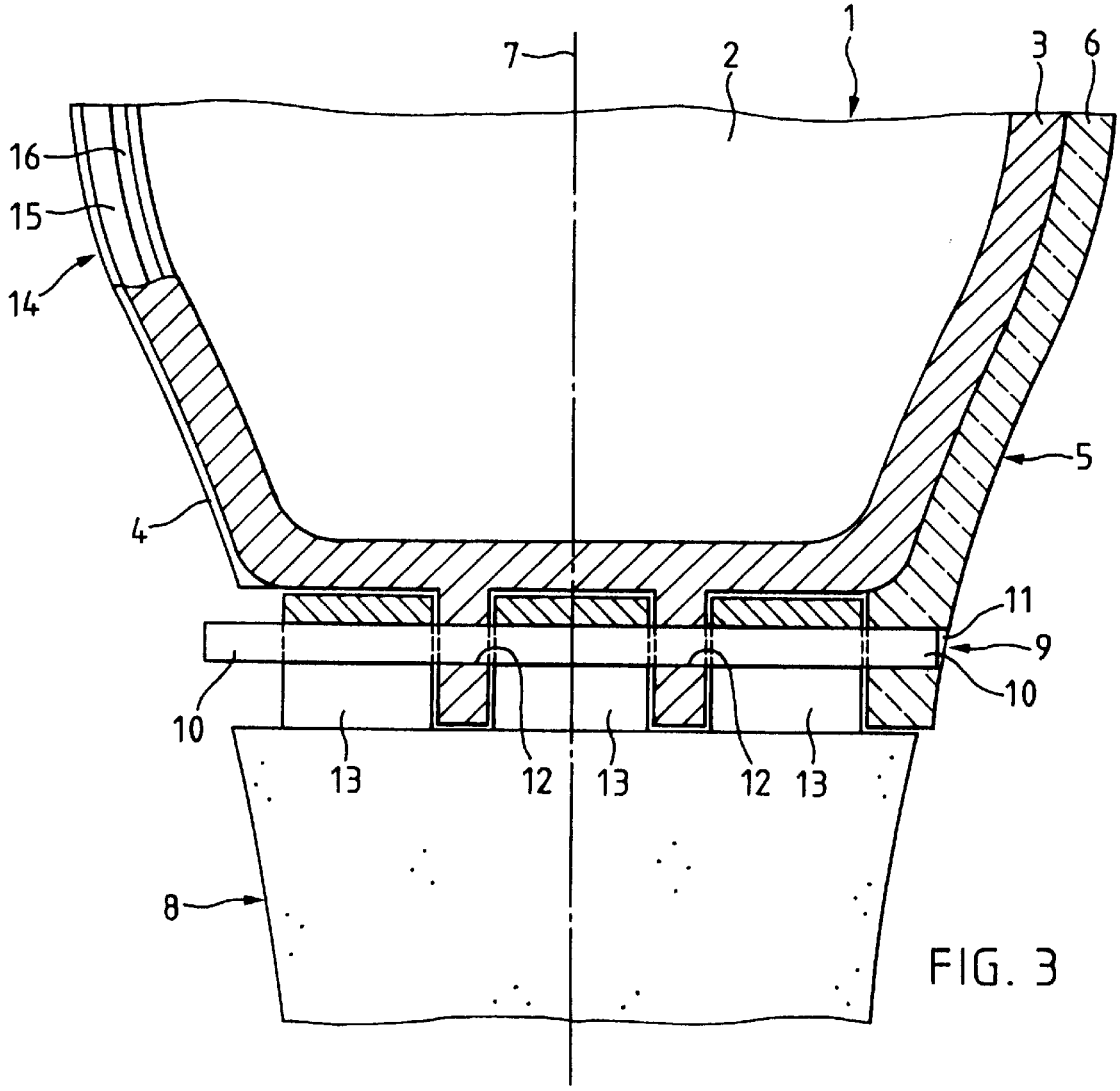
FIG. 3
FIG. 6
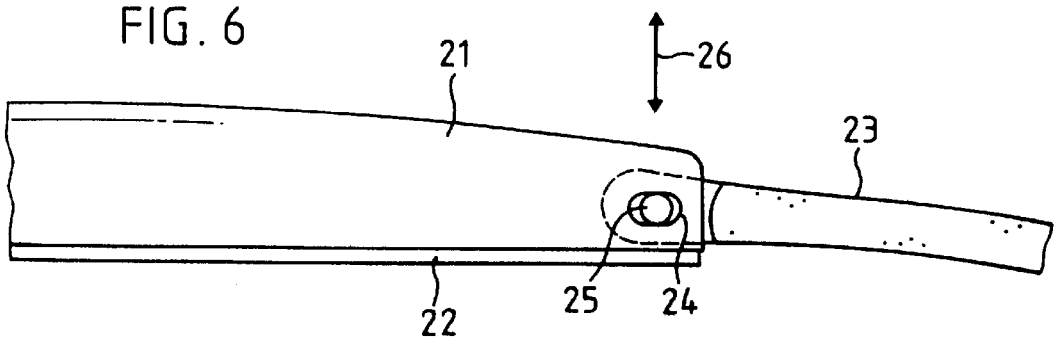

WRIST WATCH

Wrist watches with hands as time indicating means (a display in the case of digital watches) have a case, in which is fitted a clockwork with time indicating means, and a bracelet or wristband fixed to both sides of the case. The case generally comprises three superimposed parts, namely a lower case part (bottom), a middle case part (dial) and an upper case part (glass), which are laterally held together by a ring-shaped or circular case part. Conventionally the strap or bracelet is fixed to the circular part. The clockwork is held between the lower and the middle case part, the latter having an opening through which passes the hand shaft. The upper case part protects with respect to the outside the time indicating means. The circular case part normally has a passage for the winder shaft.

On more modern watches the circular case part is shaped at a number of points on the lower or middle case part, i.e. a one-piece shell takes over the function of the bottom and the circular part (described eg. in EP-A-98 239) or a corresponding shell-like dial takes over the function of the middle and circular case part (e.g. the Tissot RockWatch).

The assembly of such watches involves a number of stages and individual parts or preassembled structures of several parts (e.g. the clockwork with dial and hands) are brought into a clearly defined reciprocal position (oriented with one another) and are joined together by self-closure or other connecting means. For each of these stages orienting and connecting aids are required, which are either e.g. in the form of corresponding grooves on the watch parts or on corresponding assembly tools and which are precisely matched to the shape of the watch parts to be assembled.

Of late, as watches have become fashion accessories and collectors' items, new demands have been made on their manufacture. It is in particular desirable if during the manufacture thereof not only the decorative patterns and designs of the watches or watch parts can be varied in a rapid model order and choice, but also this applies with respect to the shapes of at least the readily visible parts. However, this is only economically acceptable if the manufacture is not significantly made more expensive by each model change. For the manufacture of individual watch parts it is possible to use various plastics moulding processes which can be relatively easily transformed for the different shapes and for the manufacture of said different shapes parts of the moulds can be replaced.

However, so as to be able to transform assembly in a simple and cost-effective manner, particularly for a differently shaped model or a model with only one differently shaped part, the watch or its parts must be correspondingly designed and this constitutes the problem of the present invention. A wrist watch is to be created from individual parts, whereof shape-differing models or models with at least one shape-differing part can be assembled with a substantially identical assembly procedure and in particular with substantially identical assembly devices.

This problem is solved by the wrist watch in accordance with the invention.

SUMMARY OF THE INVENTION

The wrist watch according to the invention has, in addition to a strap or bracelet and a clockwork with time indicating means, a lower, a middle and an upper case part, the side wall of the case (circular case part) being formed by mouldings on at least one of the case parts. The watch has two connecting areas, which embrace areas of a maximum number of watch components and which are constructed in such a way that the components in said areas engage ia one another so that their reciprocal position is defined or definable in easy manner in a maximum number of directions and that the corresponding components can be interconnected with simple means in said connecting areas in a temporary manner, i.e. for one or more assembly stages, or definitively. The standardized connecting areas at least relate to the bracelet and two of the case parts and create an interface connection between said elements.

Over a generation of watch models the connecting areas are retained as standardized areas or interfaces with respect to their design and relative, reciprocal position. Thus, the requirements with respect to the watch components are essentially limited to the connecting areas where they must fulfil certain predetermined functions, whereas in other areas they can have a freely selectable shape. During the assembly the connecting areas are used for the reciprocal orientation of the individual parts, as orientation and application points for assembly and orientation/alignment tools and advantageously also as a definitive connection or joint or parts of the latter between the individual watch components.

The connecting areas are preferably narrow or very narrow and consequently ensure for the shape design of the remaining watch areas a very considerable degree of freedom.

Watch parts designed in this way can be introduced in "flowing" manner into the assembly process. Thus, e.g. in the middle of the assembly process and whilst retaining all the other parts, it is possible to introduce an outer case having a different shape, a dial with a different decoration, etc. As a result of the optically non-noticeable interfaces (connecting areas), but which are functionally important, watches can be randomly individualized without making their manufacture significantly more expensive and which could hitherto only be achieved with considerable effort.

The principle of the wrist watch according to the invention is described in greater detail hereinafter relative to exemplified embodiments and the attached drawings, wherein show:

FIGS. 1*a* to 1*e* Diagrammatic representations of different embodiments of the wrist watch according to the invention.

Figure 2A:
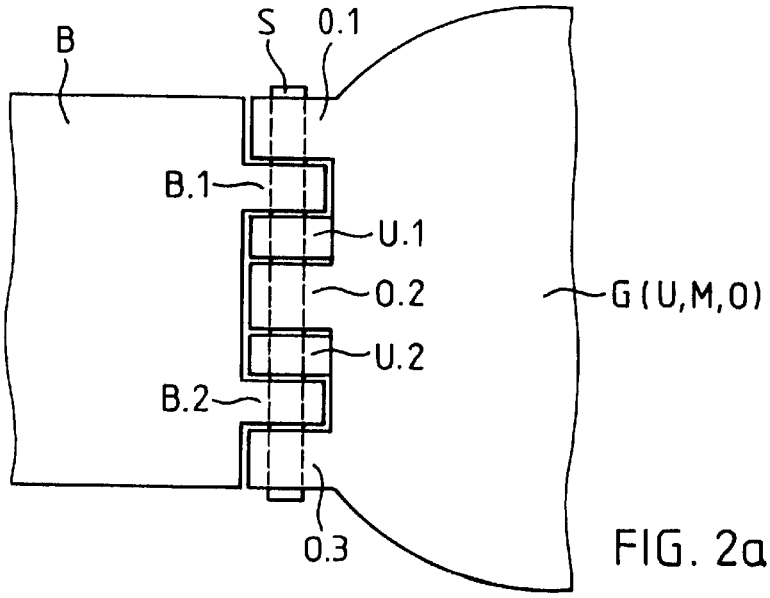
Figure 2B:
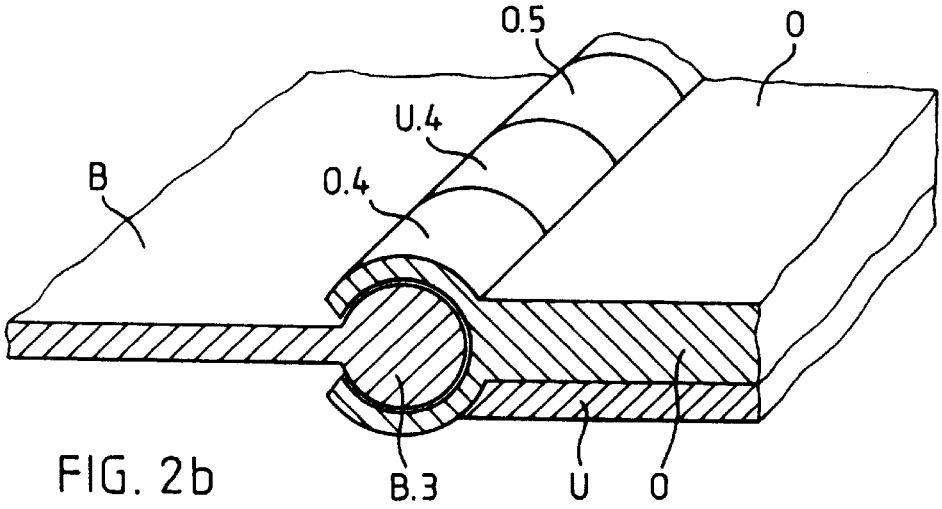
Figure 2C:
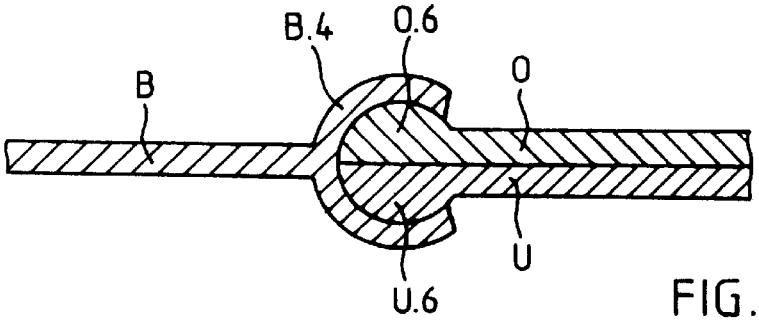

FIGS. 2*a* to 2*c* Three exemplified embodiments of the connecting areas.

FIG. 3 Part of a wrist watch according to the invention sectioned parallel to the hand plane.

Figure 4:
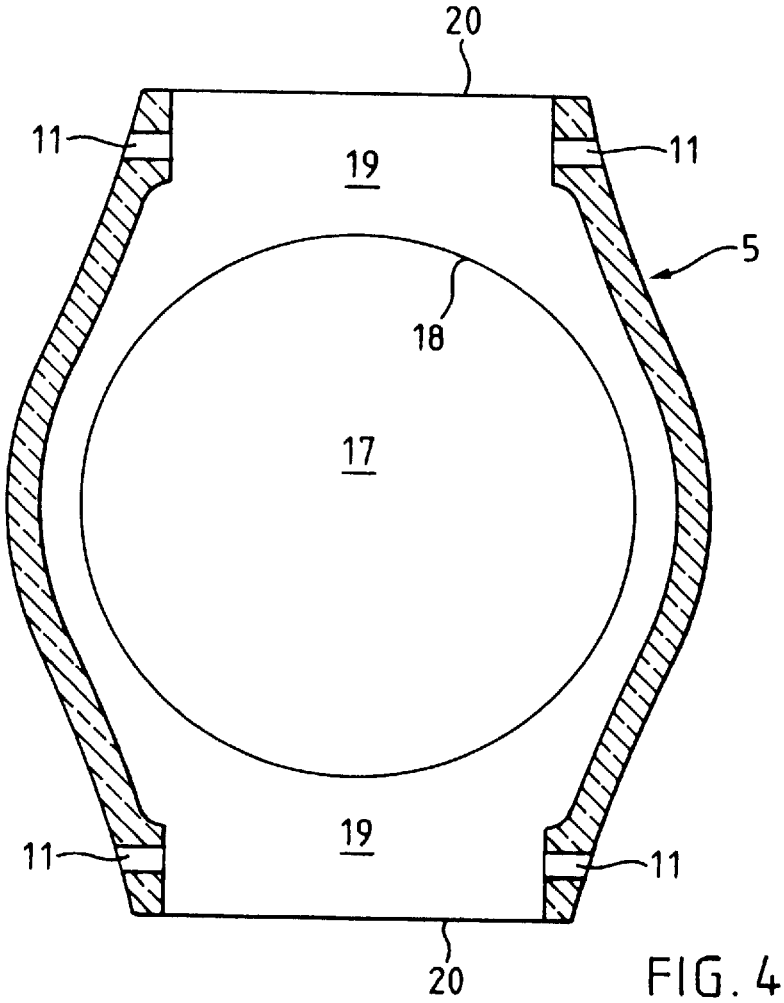

FIG. 4 A cover glass or dial for the wrist watch according to FIG. 3 sectioned parallel to the hand plane.

Figure 5:
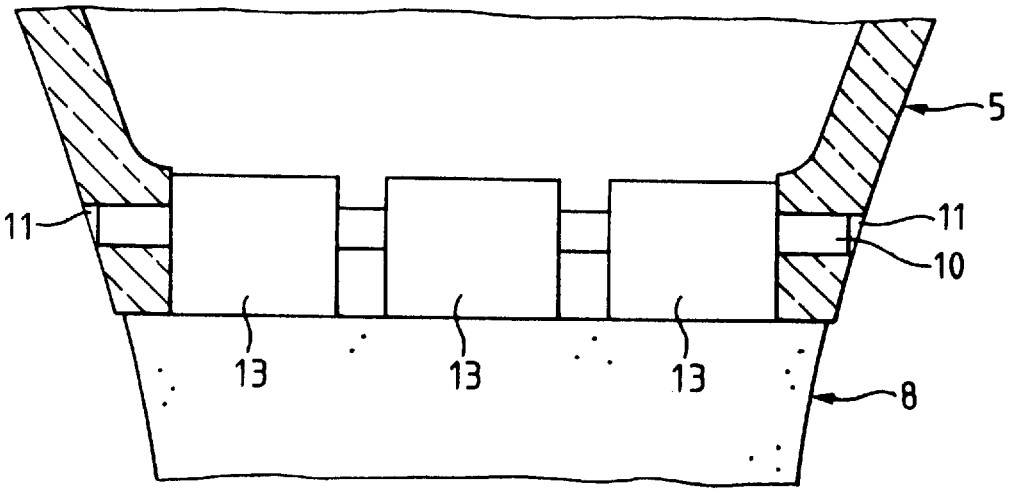

FIG. 5 A cover glass or dial according to FIG. 4 with a bracelet.

FIG. 6 A side view of an embodiment of a wrist watch according to the invention substantially corresponding to that of FIG. 3.

Figure 7:
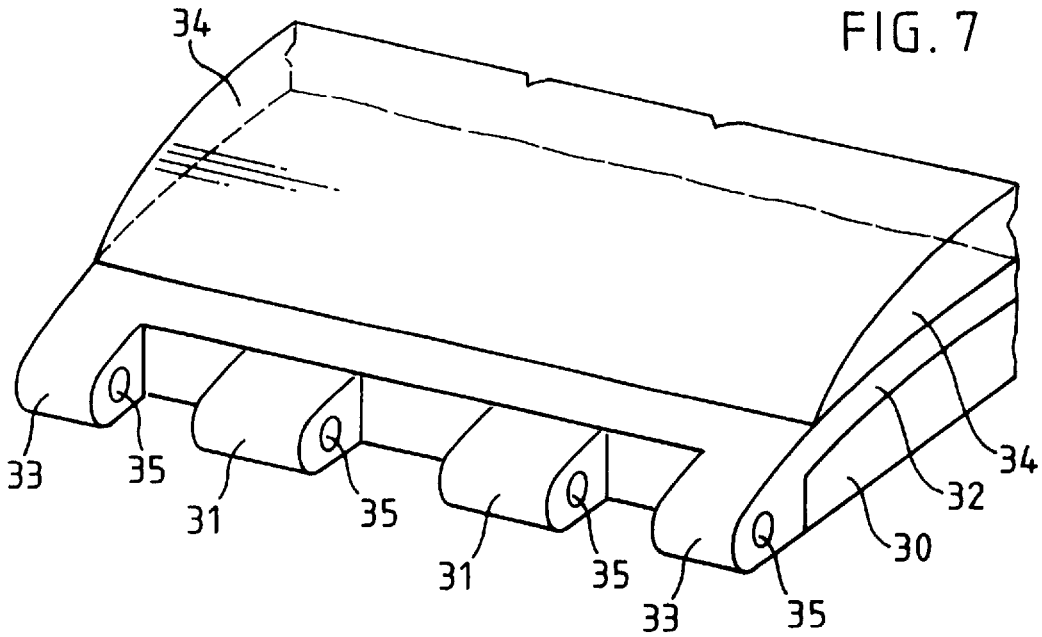

FIG. 7 A perspective view of a connecting area including, in addition to the not shown bracelet, the lower and middle case parts.

Figure 8:
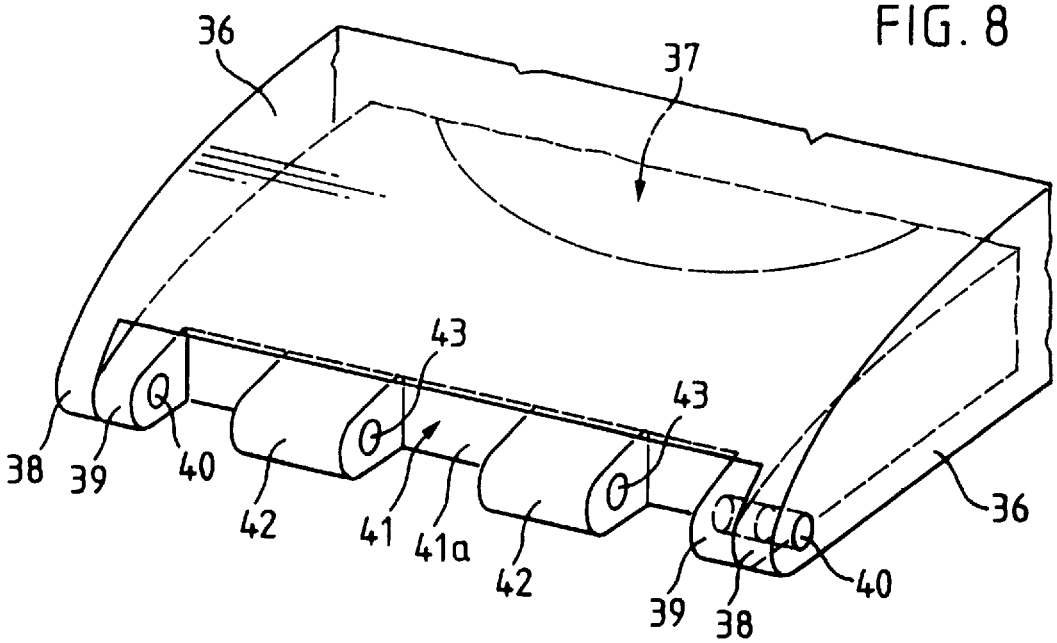

FIG. 8 A perspective view of a connecting area, including apart from the not shown bracelet, the upper, middle and lower case parts.

Figure 9:
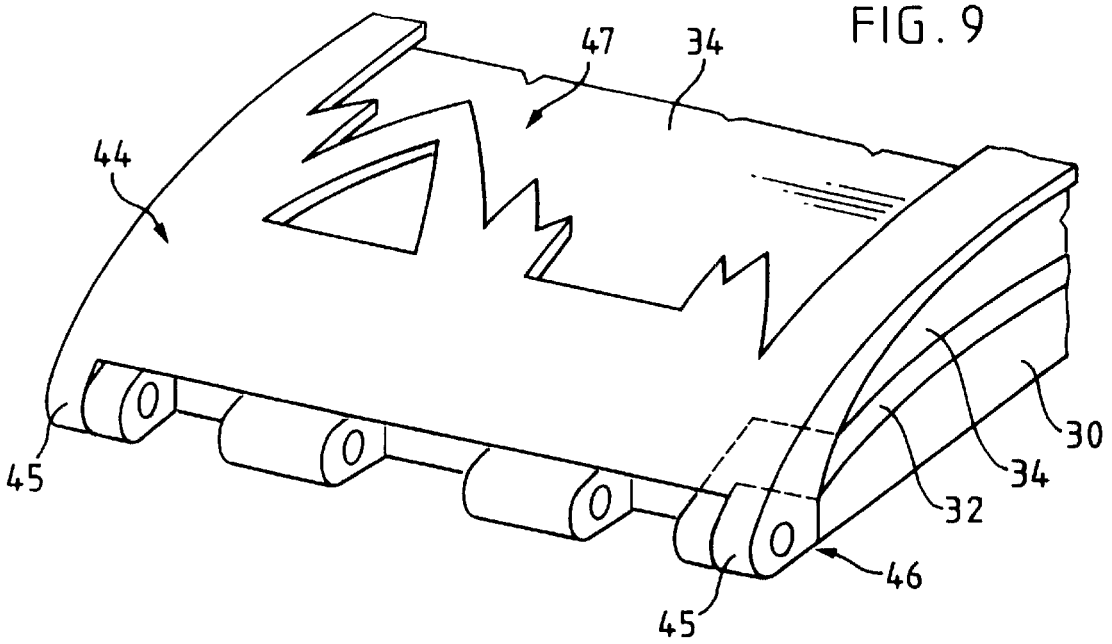
Figure 10:
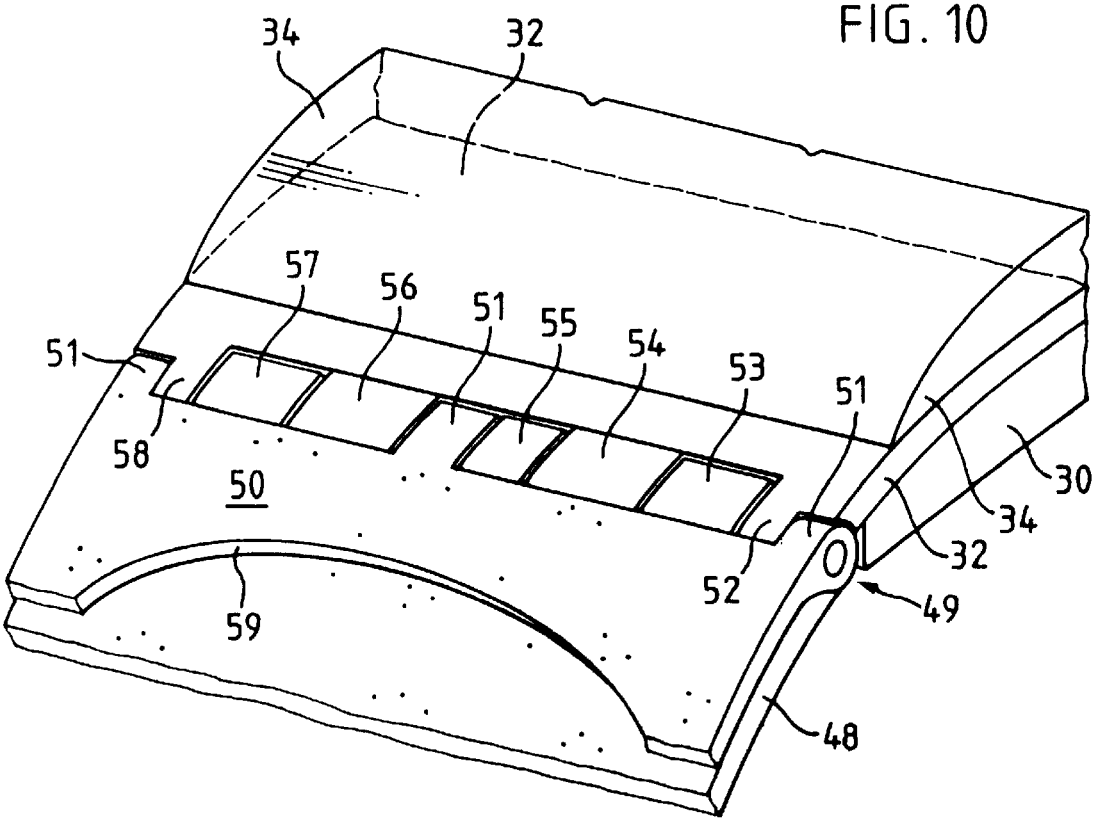

FIGS. 9 and 10 In each case a perspective view of a connecting area including additional elements.

FIGS. 11 to 18 Sections at tight angles to the band plane through further exemplified embodiments of the wrist watch according to the invention.

For illustrating the principle of the wrist watch according to the invention FIGS. 1*a* to 1*e* show corresponding watches. FIG. 1*a* shows a wrist watch in plan view. It has a strap or bracelet B, which is flexibly fixed to the case G on opposite sides. The case G comprises an upper (O), middle 9M) and lower (U) case part, which are superimposed and surrounds a clockwork, whereof in the drawing it is only possible to see the hands Z and the winder K. Production-advantageous connection areas $V_1$, $V_2$, $V_3$, etc. are located within the dot-dash lines and are generally designated V and constitute the standardized or standardizable areas, such as are to constitute interfaces.

FIGS. 1*b* to 1*e* show corresponding watches perpendicular to the plane in which the hands move (hand plane), namely along a line designated b,c,d,e in FIG. 1*a* and which essentially passes from 3 to 6 o'clock (dial marking). In the sectional representations it is possible to see that the clockwork W is held between a lower (U) and a middle (M) case part, that the middle case part (M) has a passage for the hand shaft and that the bands Z are located between the middle (M) and upper (O) case parts. Here again a standardized connecting area is marked by a dot-dash line border. As a result of the section placement the winder K unusually points to the right.

Figure 1B:
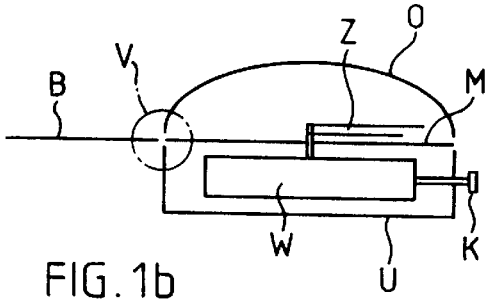

FIG. 1*b* shows an embodiment in which the side wall of the watch is shaped onto the lower case part U, so that the latter is shell-shaped and has a passage for the winder shaft. All three case parts U, X and O, as well as the bracelet B extend into the connecting area V, i.e. all three case parts and the bracelet are interconnected or at least connectable in the standardized connecting area.

Figure 1C:
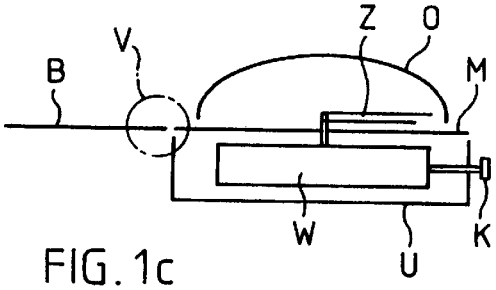

FIG. 1*c* shows an embodiment in which the upper case part O is separately fixed to the middle case part M and does not extend into the connecting area V. In the standardized connecting area the middle (M) and lower (U) case parts and the bracelet B are interconnected or interconnectable.

Figure 1D:
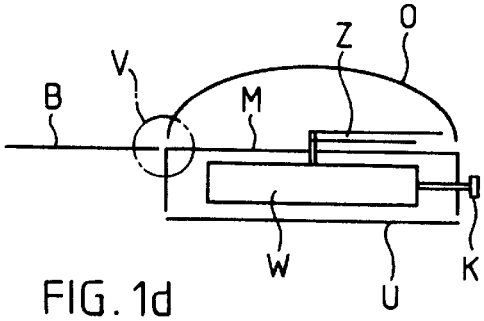

FIG. 1*d* shows an embodiment, whose middle case part M has a shell-shaped construction and a passage for the winder shaft. The bracelet B, the upper (O) and the middle (M) case parts extend into the standardized connecting area V, whereas the lower case part U is separately fixed to the middle case part M.

Figure 1E:
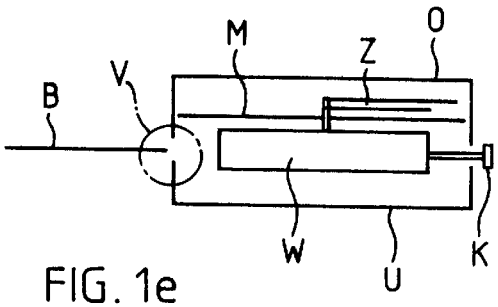

FIG. 1*e* shows an embodiment in which the upper (O) and lower (U) case parts have in both cases a shell-shaped construction, so that the winder shaft can be passed between the two parts. Apart from the bracelet B, the standardized connecting area V includes the lower (U) and upper (O) case parts, the middle case part (M) being e.g. secured between the two other case parts.

It is clear from FIGS. 1*b* to 1*e* that numerous embodiments are conceivable for the wrist watch according to the invention. It is also possible to conceive mixed forms of the represented embodiments, in which the lateral case wall is zonally formed by mouldings of different case parts and those in which said lateral wall is zonally formed by superimposed mouldings of different case parts. The main feature of the wrist watch according to the invention is constituted by the standardized connecting areas, in which the bracelet and at least two of the three case parts are interconnected or interconnectable in matched manner.

FIGS. 2*a* to 2*c* show three exemplified embodiments of connecting areas for the wrist match according to the invention. FIG. 2*a* is a plan view of a connecting area, which is constructed as a hinge with a hinge pin S. Both the strap or bracelet B and e.g. the lower and upper case parts have hinge mouldings or extensions (B.1, B.2, O.1, O.2, O.3, U.1 and U.2) with holes for the hinge pin. These mouldings are so positionable that the holes have the same axis and the pin can be passed through, so that the three parts are connectable. It is clearly visible that the mouldings of the connecting areas can also serve as orientation or alignment aids. In particular the moulding O.2 between the mouldings U.1 and U.2 determines the reciprocal position of the upper and lower case parts in the paper plane. For the assembly of the two case parts, prior to the assembly of the bracelet, an assembly pin can be inserted in the holes, which determines the reciprocal position of the two case parts at right angles to the paper plane.

In the same way as shown in FIG. 2*a*, apart from the bracelet, all three case parts can be interconnected or interconnectable in the connecting area.

FIGS. 2*b* and 2*c* show further embodiments of connecting areas for a watch according to the invention. They are also hinges, but do not have a separate hinge pin. The function of the hinge pin is taken over in the embodiment of FIG. 2*b* by a moulding or extension B3 e.g. of the bracelet B, which are surrounded by corresponding two-part extensions of the case parts (O.4, U.4, O.5) forming an opening, the extensions or mouldings of the different case parts alternating over the width of the bracelet (O.4, U.4, O.5) FIG. 2*c* shows an embodiment in which the bracelet B carries a two-part extension B.4 forming an opening and into which project the paired extensions U.6/O.6 of the case parts.

Exemplified embodiments of the wrist watch according to the invention will be described in detail relative to FIGS. 3 to 18. They all have connecting areas in the form of hinges between the bracelet and the case so that, unlike in the prior art, they render connectable to one another and to the bracelet at least two case parts and not merely one case part, which is usually circular or shell-shaped. Thus, in the connecting area is formed a connection triangle, in which can e.g. be connected the shell (lower case part) to the bracelet or strap and additionally e.g. also said bracelet can be connected to the cover glass (upper case part) and therefore also the cover glass with the shell or can even be fixed thereto. This connection triangle, whose corner points or angles are formed by the shell, the bracelet and the glass (corresponding to FIG. 1*e*) consequently has three connections, namely in each case one between the cover glass and the shell, between the glass and the bracelet and between the bracelet and the shell. However, all these connections pass via the same connecting element, i.e. the hinge. Thus, it is not necessary to have direct connections between these parts. This leads to the novel possibility of to a greater or lesser extent weighting or stressing the extent or strength of these three connections and consequently giving a completely new configuration to the watch construction. Correspondingly, in place of the cover glass (upper case part), also the dial (middle case part) can be incorporated into said connection triangle and take up one of the angles (according to FIG. 1*c*). According to a further variant of the invention it is also possible to incorporate the dial (middle case part) and cover glass (upper case part) jointly into the fastening means for the bracelet (according to FIG. 1*b*). In this case the connection triangle is extended to a connection square and the corner points or angles are the shell, bracelet, dial and glass. Through the incorporation of further elements into the connection, it is possible to aim at a connection polygon.

In addition to the connections of the connecting areas it is possible to provide further connections between the parts of the case. Such connections assist the connections of the connecting areas either definitively or only during the assembly of the watch. Such further connections can preferably exist between the cover glass and the dial or between the dial and the shell and can e.g. be in the form of welded joints.

Thus, it is e.g. possible to provide direct connections between two of the case parts, so that said two elements form a fixed unit with increased bending or torsional resistance. The individual elements can consequently be made relatively weak, because they acquire a higher strength by an appropriate, additional connection. For example, the shell can be firmly connected to the dial over its entire circumference, e.g. by a closed weld and consequently the shell can be given a relatively weak construction. Subsequently the cover glass need only be connected to the shell-dial combination in the previously described connecting area.

The fact that according to the present invention a choice exists of fixing the individual elements of a watch both directly to one another and also in the above-described connecting area, there are considerably widened possibilities with respect to the design and external styling of the watch. Thus, more ways are available in order to adapt an attractive external configuration in accordance with the internal design, so that the watch also meets the standard demands.

For example, the dial (central case part) can also be shaped three-dimensionally or in shell form and consequently has a certain inherent rigidity, which can be so utilized in watch design that e.g. there can be reductions with regards to the rigidity of other elements. The dial can be connected in the described connecting area and/or directly to the cover glass. Thus, it is e.g. also possible to anchor the bracelet in virtual, i.e. visible from the outside manner, to a hinge element (connecting area), but in reality there is a direct connection between the dial and the bracelet, which can mean that both can be in one piece.

Further advantages resulting therefrom are in particular that e.g. the wrist watch can be optically designed in such a way that the shell is no longer visible, by introducing the bracelet directly into the cover glass and by the latter also covering the lateral faces of the shell. On the cover glass this leads to large faces not reserved for time indication purposes and which can e.g. be printed. These faces can also be designed in such a way that a continuous, transitional surface is formed between the bracelet and the dial, or at least a surface which is optically perceived in this way. The cover glass can be positioned and fixed to the shell in the connecting area. Tensile forces from the bracelet can at least partly be introduced into the cover glass. Said functions may also be exercised by the connecting area elements in only a temporary manner, e.g. during watch assembly. This leads to new advantages permitting a more rational manufacture, in that assembly aids can be avoided, because they already form part of the watch. Similar advantages are obtained for a variant in which in place of the cover glass the dial is functionally incorporated in the fastening to the bracelet. Then the dial can be designed in such a way that the shell is no longer visible below it and forces can be introduced in weighted form into the dial or the shell. Virtually unimagined possibilities exist if the dial and cover glass are incorporated into the connecting area and said connection square is formed. It must be borne in mind that it is possible for the connection square to only be apparent or virtual, whereas in reality there is only a connection triangle. This is e.g. the case if connections between the four angles or the elements represented by them admittedly exist, but in reality are not made to act. For example, this can be brought about in that one of the connections is not made to bear, i.e. it is so constructed that it cannot transfer any forces. It is also possible to construct such connection triangles or squares only for certain forces (e.g. torsional forces), but not for other forces (e g. compressive forces).

In this way e.g. the dial is also visible from the side, i.e. in profile. Thus, said profile can be designed and in this way the watch is optically even further set apart from other watches.

A further advantage is that the seal between the two parts is simpler and more reliable. As a result of the watch case design according to the invention it is also possible for the dial to have not only decorative functions. The dial can now directly form the connection between the cover glass and the shell and can therefore also exert a supporting or bearing function. It is also now unimportant whether the dial has figures, lines or any elements, which make it possible to determine the hand position. The term dial is understood to mean the aforementioned middle case part which, as described in conjunction with FIGS. 1*a* to 1*e*, can have different forms. This middle case part can have on its top a marking for the hand position and this can also be in the form of a coating or a flat, additional part.

Further advantages result from the incorporation of a "three-dimensional" dial into the watch case design (cf. also FIG. 1*d*). This leads to a simplification of the production process, because the design impression of the watch case is now in the widely varying shaping of the dial and it is possible to use for the shell and cover glass standardized components with correspondingly standardized zones for the connecting areas. Thus, e.g. the winder shaft can be guided through the dial. For this purpose the dial need not necessarily be part of the watch case, because such a three-dimensional dial according to the invention can also be incorporated into the watch case formed by the upper and lower case parts (cf. also fig. 1*e*).

This permits a complete utilization of the design and styling possibilities with respect to the shaping of the dial and in addition the winder can be incorporated into the artistic design of the watch. Apart from the use of dials with different thicknesses, it is also possible to fit widely differently dimensioned winders. The dial and winder can consequently be designed as a unit, which creates an additional and highly desired interlinking of the decorative elements.

FIG. 3 shows a section parallel to the hand plane through part of an exemplified embodiment of the wrist watch according to the invention. It is possible to see a shell 1, which e.g. has a bottom 2 and a side wall 3. Outside the side wall 3 it is possible to see a shoulder 4, on which is placed part of a cover glass 5. A cover glass 5 is only represented here with part of its side wall 6. The cover glass 5 is also only shown on the right-hand side of a line 7, but is omitted on the left-hand side in order to render visible somewhat more of the shell 1. A bracelet half part is designated 8. Between the bracelet 8, shell 1 and cover glass 5 is provided a connecting area 9 in the form of a hinge. This connecting area 9 essentially comprises a pin 10, which is mounted in holes 11 in mouldings of the cover glass 5, in holes 12 in mouldings on the shell 1 and which is more or less closely looped by loops 13, which are part of the bracelet 8 and form openings for the pin 10. Thus, in this example the pin 10 has the following effects. It connects the cover glass 5 and the shell 1 to one another. It connects the shell 1 to the bracelet 8 and the glass 5 to the bracelet 8. The pin 10 is e.g. held by a press fit in the loops 13.

In the left-hand part of FIG. 1 it can be seen that in an area 14 the side wall 3 of the shell 1 is not represented in sectional form, so as to render visible a surface 13 of the side wall 3 in which is formed a groove 16. In said groove 16 the cover glass 5 can e.g. be additionally fastened to the shell 1. Preferably said groove 16 is provided on the entire circumference of the shell 1 and is also constructed as a sealing element. As required, the cover glass is fixed to a greater or lesser extent via the groove 16 to the shell 1. Thus, the fastening of the cover glass to the shell need only have a temporary character in the connecting area 9, namely during the assembly of the glass 5 with the shell 1 and for as long as e.g. an adhesive in the groove 16 fails to exercise a holding function.

FIG. 4 shows a cover glass 5 with its holes 11 for a pin 10 (FIG. 3). It is also possible to see an area 17 bounded by a circle 18. In this area 17 the cover glass 5 is transparent and gives a free view of the hands and a dial. Outside the circle 17 is a zone 19, which has a free graphic design and can e.g. be printed, because it need not be transparent. This zone 19 extends up to the lines 20 to which the bracelet is connected. A dial can be constructed in the same way as the cover glass 5, so as to have precisely the same shape, but is possibly made from a different material, because it need not be transparent. The area 17 is then intended for the representation of time marks and the zone 19 is once again open to free graphic design.

FIG. 5 shows the connecting area of a watch according to FIG. 3 for the combination of the cover glass or dial 5 and the bracelet 8 without the shell. The bracelet 8 is secured by the pin 10 to the glass or dial 5. The holes 11 and the loops 13, shown in elevation here, are already known from FIG. 3.

FIG. 6 is a side view of part of a wrist watch according to the invention, which essentially corresponds to that of FIG. 3. It is possible to see a cover glass 21, a shell 22, which is almost no longer visible, and half of a bracelet 23. In the glass 21 can be seen a hole 24 and a pin 25. The hole 24 is elongated instead of round namely in the direction in which tensile forces can occur from the bracelet 23. Thus, tensile forces are not transferred or only transferred to a limited extent between the bracelet 23 and the glass 21. However, forces can be transferred between the shell 22 and the cover glass 21, provided that they are directed in the direction of an arrow 26 or have components in this direction and the pin 25 is firmly seated in the shell 22. This is assumed here, because it cannot be seen in FIG. 4. A construction of the hole 24 in such a way that its greatest extension was in the direction of the arrow 26 would mean that in particular tensile forces were transferred between the bracelet 23 and the glass 21, but the pin 25 would scarcely fix the glass 21 to the shell 22.

FIG. 7 shows the connecting area of a wrist watch according to the invention with a shell 30, on which are provided extensions or mouldings 31 for a connection to the not shown bracelet. It is also possible to see a dial 32 or an element containing or carrying a dial and which also has extensions or mouldings 33 extending into the connecting area. Above the dial 32 is placed a cover glass 34. In the mouldings 31 and 33 are provided bores 35, in which can be inserted a not shown pin, so as to interconnect the shell 30, dial 32 and bracelet.

FIG. 8 shows a further variant of the connecting area into which is also incorporated the cover glass 36. The cover glass 36 and dial 37 have mouldings 38, 39 with holes 40. A shell 41 can only be seen by its end face 41*a*, on which are provided mouldings 42 with holes 43, which are equiaxial to the holes 40 and which are provided for receiving a pin and therefore for fixing together the case parts and also the latter to the bracelet. Through different dimensioning of said holes 43, 40 in the shell 41, the dial 37 and the glass 36 it is once again possible to determine whether a connection between a pair of said elements is to be active and with respect to which forces it is to be active.

FIG. 9 shows another embodiment of the connecting area into which an additional element has been incorporated. The further element here is in the form of a decorative shield or plate 44, which covers part of the glass 34 and dial 23 and extends with mouldings 45 into the connecting area. The decorative plate 44 has at least one opening 47, so as to free the view through the glass 35 onto the not shown hands and dial 23. In this variant the shell 30, dial 32, cover glass 34, not shown bracelet and decorative plate 44 are interconnected in the connecting area 46. In place of being positioned over the cover glass 34, the decorative plate could also be inserted between the glass 34 and the dial 32.

FIG. 10 shows another variant of a connecting area into which an additional element is incorporated. The additional element in the form of a protective element 50 associated with the bracelet 48 with e.g. large openings 59 also has mouldings 51, which extend into the connecting area 49. Apart from the mouldings 51 of the protective element, the connecting area 49 also has mouldings 52, 58 of the dial, loops 53, 55 and 57 of the bracelet 48 and mouldings 54, 56 of the shell 30. As stated, in a connecting area 46, 49 are interconnected or interconnectable not only three, but four, five or more parts. Apart from the bracelet and case parts further elements can be easily integrated into the connection such as decorative plates 44, protective elements 50 or elements having further functions.

FIGS. 11 to 18 show further details of embodiments of the watch according to the invention, all the representations being sections at right angles to the hand plane. In said sections is only shown in each case one moulding or extension of a case part for the connecting area and no specific reference will be made thereto in conjunction with these drawings.

Figure 11:
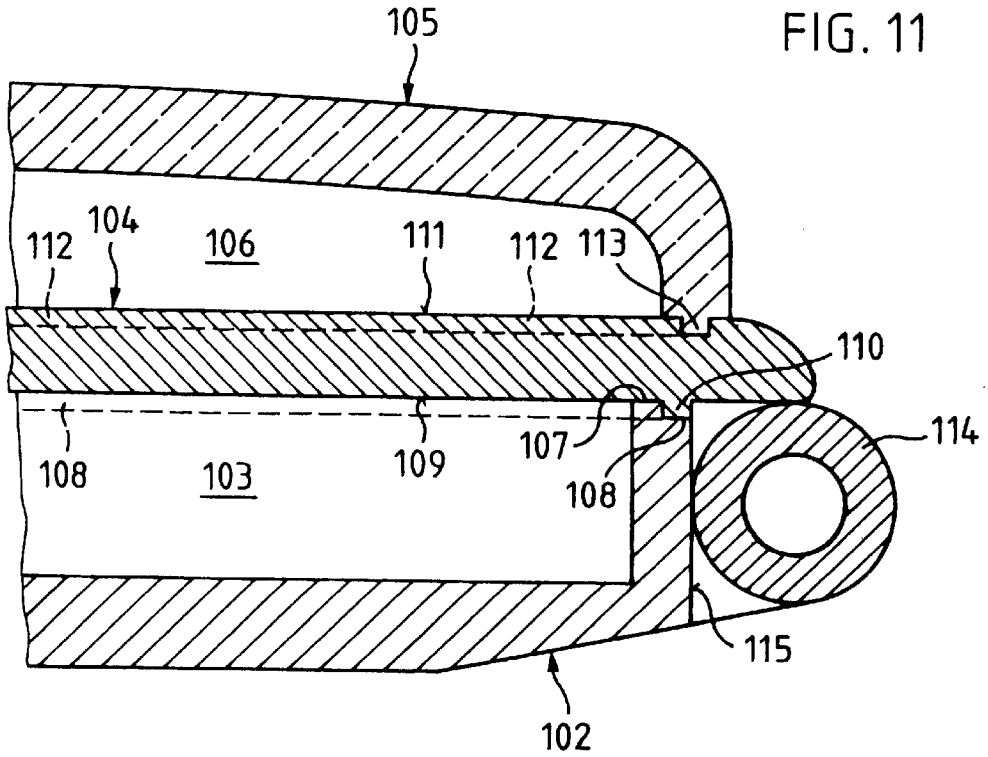

FIG. 11 shows part of a case for a wrist watch according to the invention. The case comprises a shell 102, whose internal shape is represented in greatly simplified form and provides a space 103 for a not shown clockwork and over which extends a dial 104. Above the dial 104 is provided a convex cover glass 105, which over the dial 104 keeps free a space 106 in which, in per se known and therefore not shown manner, are positioned hands. The shell 102 has on its upper border or edge 107 a groove 108, which extends over the entire circumference. On its lower boundary surface 109 the dial 104 has an extension, which engages in the groove 108. The extension 110, together with the groove 108, forms a direct connection or fastening between these two parts. On its surface 111 the dial 104 also has a groove 112 in which engages an extension 113 of the glass 105. This gives a further direct connection or fastening between the glass 105 and the dial 104. It is possible to see a moulding 114 on the shell and which forms part of a connecting area. The dial also has not visible mouldings of this type. If it is e.g. assumed that the shell essentially has a cylindrical outer boundary, which is formed by a surface appearing here as a line 115, then the cover glass 105 projects beyond the shell 102. Preferably the extensions 110, 113 are fixed by welding (e.g. ultrasonic welding) or adhesion in the grooves 108 and 112, so that simultaneously a seal is formed.

Figure 12:
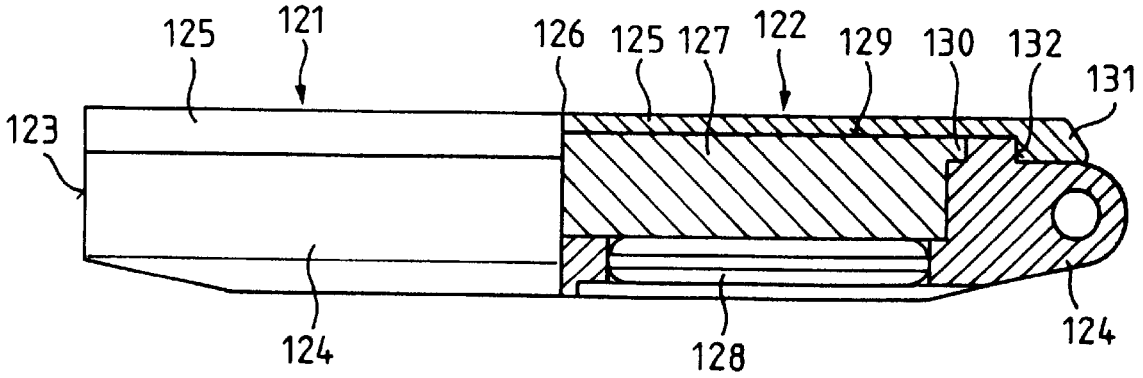

FIG. 12 shows two halves 121, 122 of a further exemplified case for a watch according to the invention, without a cover glass. The half 121 merely shows the profile of the case, such as is obtained if the case intersects between the centre 126 and a zone which is approximately at 9 o'clock on the dial. It can be seen that the shell 124 and the dial 125 have e.g. a common cylindrical outer face 123. The half 122, which is approximately in the form of a section between the centre 126 and 6 o'clock on the dial, gives a free view of a clockwork 127 and an electric battery 128. On its upper edge 129 the clockwork 127 has an outwardly directed shoulder 130, which is supported in the shell 124. The dial 125 is secured in the upwards direction by the clockwork 127, which in this case has a reinforced border 131, which also covers an additional lateral face 132 of the shell 124.

Figure 13:
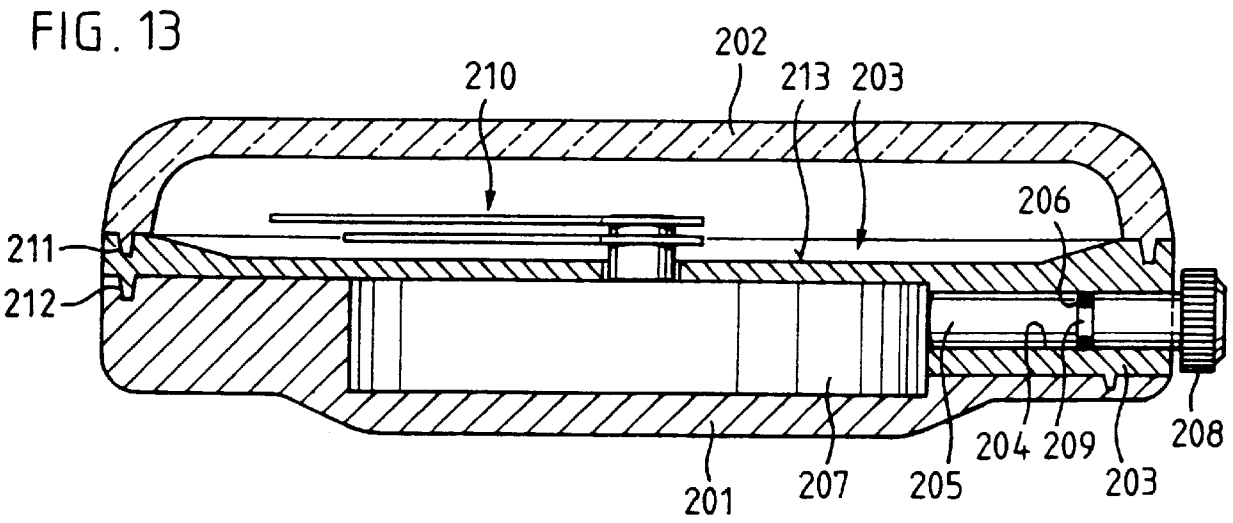

FIG. 13 shows a wrist watch according to the invention, which is characterized in that the winder shaft passes through the dial (cf. FIG. 1*d*). The watch is sectioned at right angles to the hand plane along a line from 9 to 3 o'clock (dial marking).

The watch case comprises a shell 201, a cover glass 202 and a dial 203. The convex cover glass 202 is fixed to the three-dimensional dial 203 by a direct connection 211, whilst the shell 201 is fixed to the dial 203 by a direct connection 212. The connections 211, 212 also fulfil a sealing function and can be produced by standard connection means in watch technology, such as e.g. ultrasonic welding and adhesion. The clockwork 207 is held by the dial 203 using a means disclosed in Swiss Patent application 960/92 and which is consequently not described here. The winder shaft 205 is fitted to the clockwork 207 and is passed by means of the passage 204 through the dial 203 end out of the watch case and carries a windor 208. The passage 204 of the windor shaft 205 is given a watertight seal by a circular seal 206 embedded in a recess 209 in the dial 203. The dimensions of the recess 209 and the seal 206 are appropriately chosen in such a way that the seal 206 has the external diameter of the winder shaft 205, so that the seal 206 is placed on said shaft 205 and can be inserted in the passage 204 of the dial 203.

Figure 14:
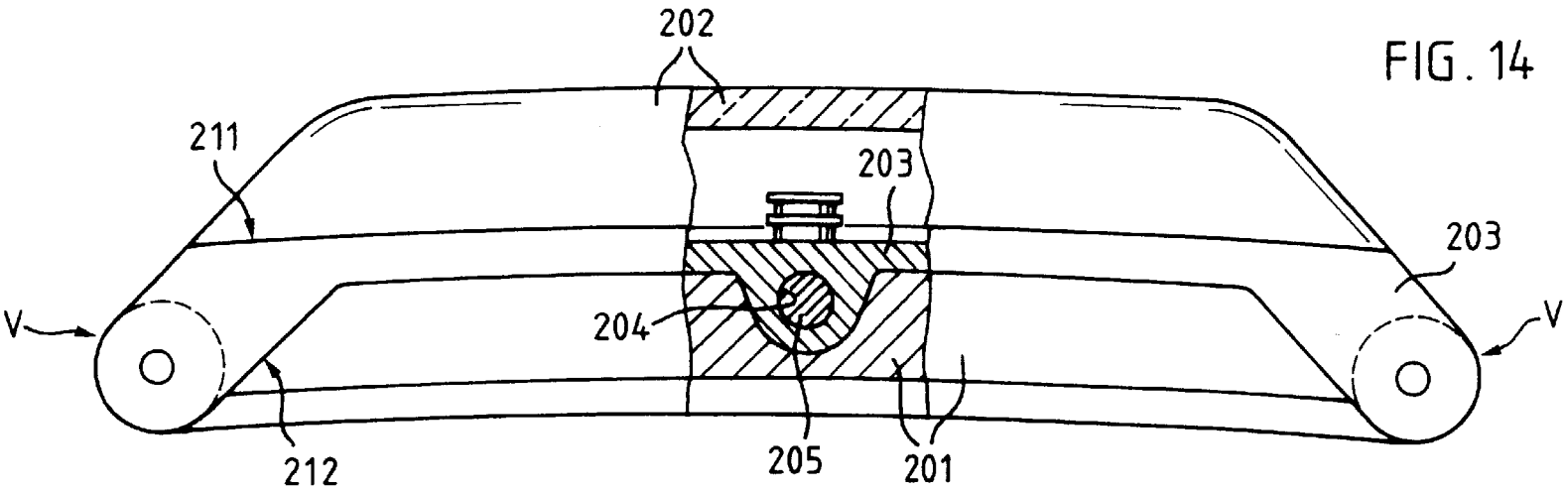

FIG. 14 shows the wrist or pocket watch according to FIG. 13 at right angles to the hand plane and to the sectional plane of FIG. 3, approximately through the 3 o'clock marking of the dial. The direct connection 211 of the cover glass 202 and dial 203, as well as the direct connections 212 of shell 201 and dial 203 are located above and below the passage 204 of the winder shaft 205 through the dial. It is also possible to see the connecting areas V into which extend moulding of the dial 203 and mouldings of the not shown shell, as well as possibly cover glass mouldings.

The assembly of the embodiment of the wrist watch according to the invention shown in FIGS. 13 and 14 advantageously takes place in such a way that the clockwork 207 is firstly fitted to the dial 203 and then the latter is fixed by means of the direct connection 212 to the shell 201. In further stages the seal 206 is inserted in the recess 209 on the winder shaft 205 and the winder 208 is mounted on the latter. The winder shaft 205 is now inserted in the passage 204 of the dial 203 and fitted to the clockwork 207. The hands 210 are then placed on viewing face 213 of the dial 203. All these stages take place prior to the final fitting of the cover glass 202 to the dial 203 by means of the direct connection 211. The connections of the connecting areas V can serve as orientation aids when producing the direct connections 211, 212 and as definitive connections between the case parts.

Figure 15:
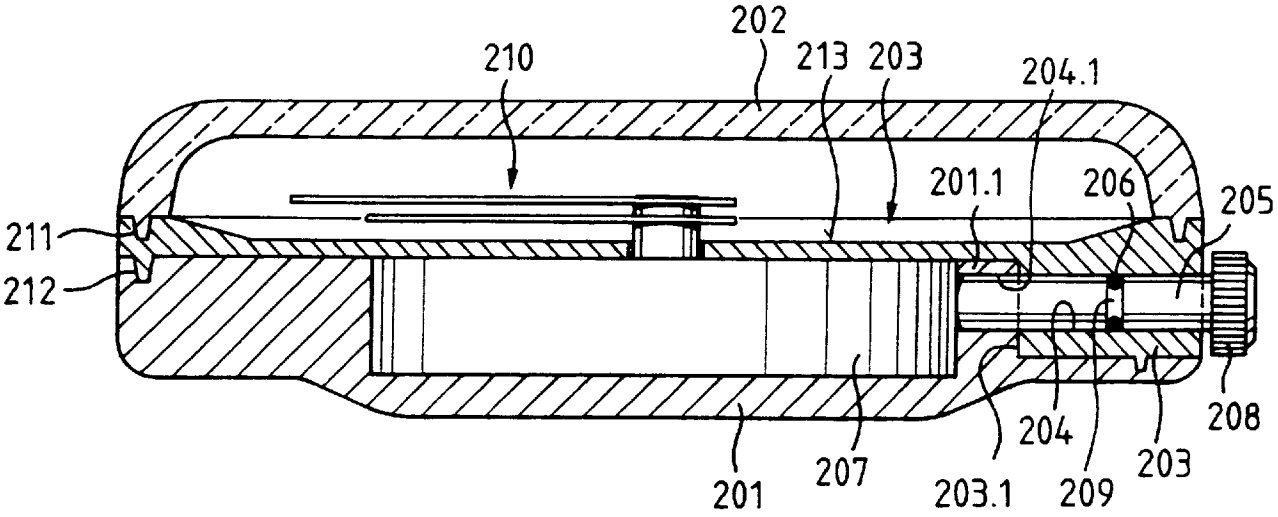
Figure 16:
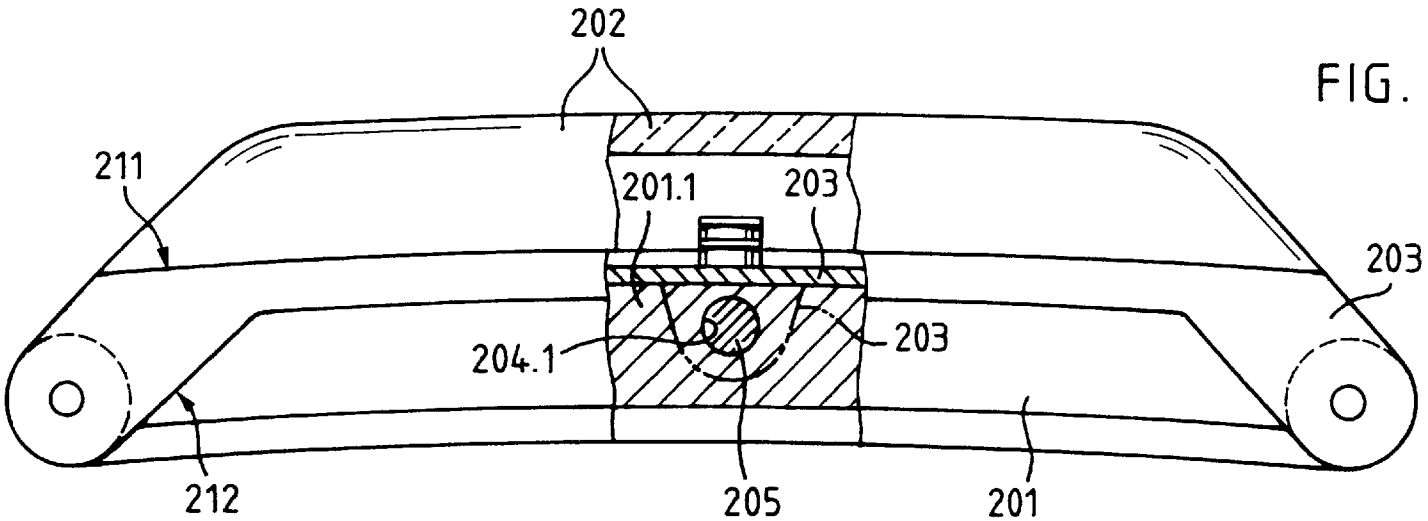

FIGS. 15 and 16 show another variant of the wrist watch according to the invention in the same representations as FIGS. 13 and 14. The watch is characterized in that on this occasion the winder shaft 205 passes through the dial 203 and shell 201. In the vicinity of the passage 204 of the winder shaft 205 the shell 201 is raised over th dial 203. The shell 201 has an inner border 201.1, which separates the lateral face 203.1 of the dial 203 from the cloc ork 207. Seen from the clockwork 207, FIG. 15 shows how the winder shaft 205 firstly passes through the passage 204.1 of the shell 201 and then the passage 204 of the dial 203.

The assembly of the wrist or pocket watch variant according to FIGS. 15 and 16 appropriately takes place in such a way that after fitting the clockwork 207 to the dial 203 and the fixing of the dial 203 to the shell 201 by means of the direct connection 212, the seal 206 is in serted in the recess 209 of the winder shaft 205 and the winder 208 is mounted on the latter. The winder shaft 205 is then firstly inserted in the passage 204 of the dial 203 and then into the passage 204.1 of the shell 201 and fitted to the clockwork 207. The hands 210 are then placed on the viewing face 213 of the dial 203. These stages take place prior to the fitting of the cover glass 202 to the dial 203 by means of the direct connection 211.

Figure 17:
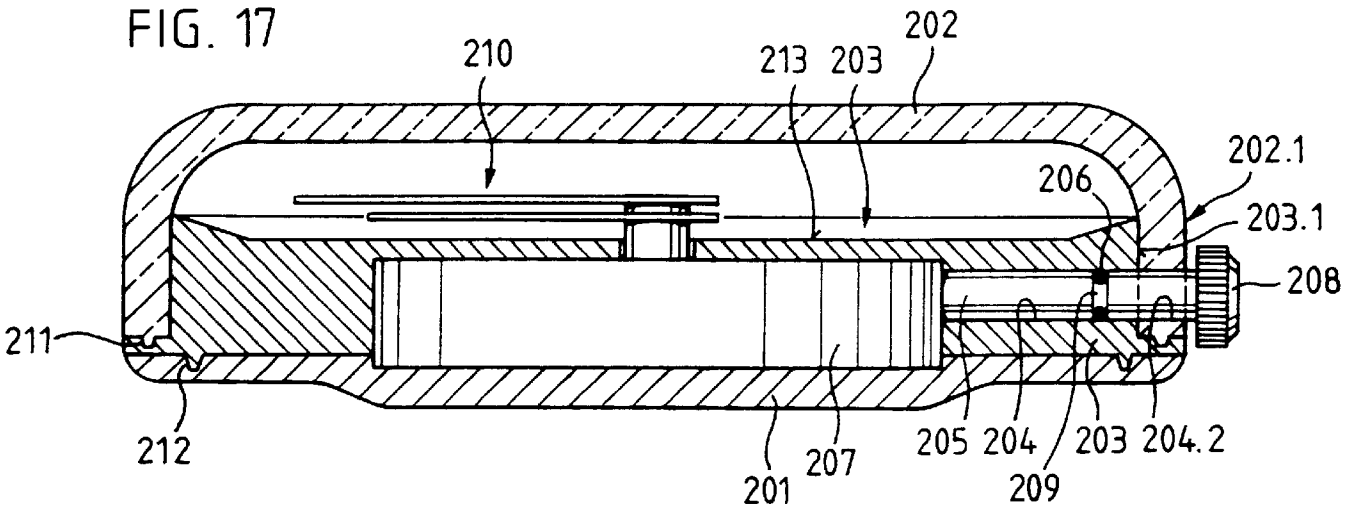
Figure 18:
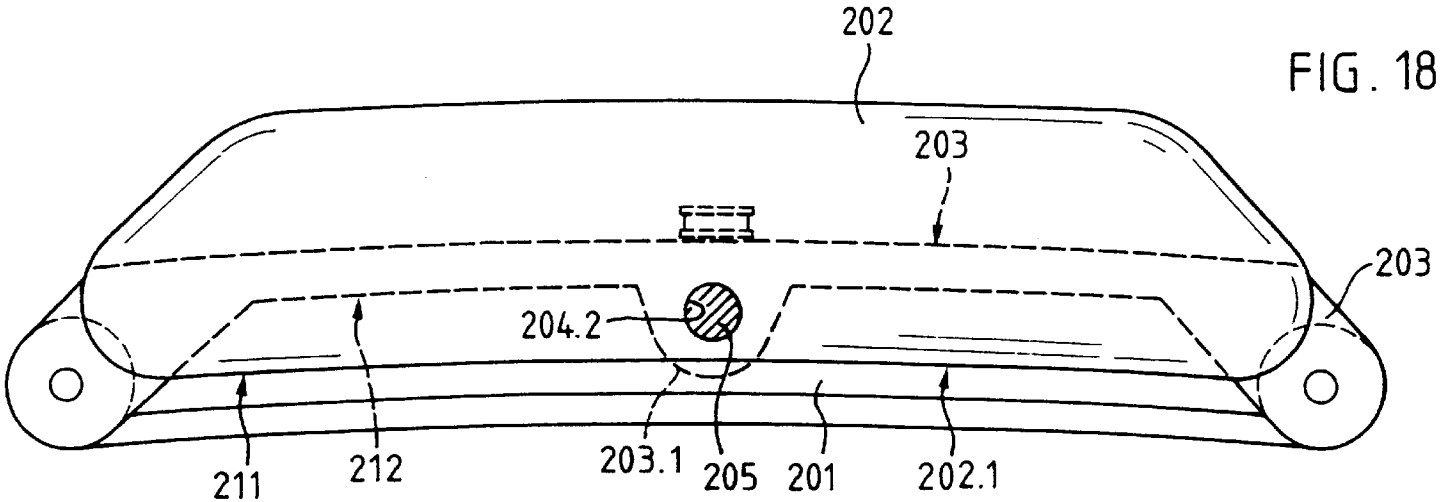

FIGS. 17 and 18 show in the same representations as FIGS. 13 and 14 another variant of the wrest watch according to the invention and which is characterized in that the winder shaft 205 is passed through the dial 203 and the cover glass 202. FIG. 18 shows how the outer border 202.1 of the cover glass 202 is drawn down over the dial 203, so that the lateral face 203.1 of the dial 203 is completely enclosed by the border 202.1 of the cover glass in the vicinity of the passage 204 for the winder shaft 205 through the dial 203. Thus, considered from the clockwork 207, the passage of the winter shaft 205 firstly passes through the passage 204 of the dial 203 and then through the passage 204.2 of the cover glass 202.

The assembly of the wrist watch variant according to FIGS. 17 and 18 appropriately takes place in such a way that in two preparatory stages the clockwork 207 is fitted to the dial 203 and the dial 203 is fixed to the shell 201 by means of the direct connection 212. The seal 206 is then inserted in the recess 209 of the winder shaft 205, the winder 208 is engaged on the shaft 205 and the hands 210 are fixed to the viewing face 213 of the dial 203. This is followed by the fixing of the cover glass 202 to the dial 203 by means of the direct connection 211. This is followed by the actual assembly of the winder shaft 205 in such a way that said shaft 205 is firstly inserted in the passage 204.2 of the cover glass 202 and then in the passage 204 of the dial 203 and is finally fitted to the clockwork 207.

In the same way as being applied to a wrist watch, the inventive concept can also be applied to a pocket or similar watch and which then, in place of a bracelet or strap, has some other element fixed thereto (fastening element e.g. for a chain, outer case or decorative element).

We claim:

1. A wrist watch comprising the combination of a case having a shell, a dial and a glass;

a clockwork contained between said shell and said dial;

time indicating means between said dial and said glass, said time indicating means being coupled to driving members in said clockwork;

a bracelet; and connecting means comprising hinges, each hinge interconnecting and attaching together at least two of said case parts with each other and with said bracelet on a common hinge axis.

2. A wrist watch according to claim 1 wherein each of said hinges includes first and second members formed respectively on two of said case parts, each of said members having a hole therethrough;

a loop on said bracelet, said loop having a hole therethrough; and a hinge pin passing through said first and second members and said loop, thereby interconnecting said bracelet and said case parts.

3. A wrist watch according to claim 1 wherein each of said hinges includes first and second members formed respectively on two of said case parts, each of said members forming an opening, said openings in said first and second members being aligned with each other; and a molding on said bracelet shaped and dimensioned to mate with and latch to said openings, thereby interconnecting said bracelet and said case parts.

4. A wrist watch according to claim 1 wherein each of said hinges comprises at least one pair of moldings, each molding of said pair being integrally formed on a different one of said case parts; and a molding on said bracelet having an opening shaped and dimensioned to receive said pair of moldings together, thereby interconnecting said bracelet and said case parts.

5. A wrist watch according to claim 1 and further comprising, in addition to said connection means, at least one direct connection between two of said case parts.

6. A wrist watch according to claim 5 wherein said at least one direct connection comprises a first attachment between said dial and said shell and a second attachment between said dial and said glass.

7. A wrist watch according to claim 5 wherein said at least one direct connection comprises a weld.

8. A wrist watch according to claim 1 and wherein said connection means further comprises a further watch part connected to said at least two case parts and said bracelet.

9. A wrist watch according to claim 8 wherein said further case part comprises a decorative or protective element.

10. A wrist watch according to claim 1 wherein said dial includes a surface facing said glass and having a watch dial thereon, said dial further including a passage for a winder shaft, said passage having a seal for sealing against said winder shaft.

11. A wrist watch according to claim 10 wherein said glass is a cover glass having predetermined lateral dimensions, and wherein said watch dial surface extends laterally beyond said cover glass.

12. A wrist watch according to claim 10 wherein said shell includes a passage for a winder shaft aligned with said winder shaft passage in said dial.

13. A wrist watch according to claim 10 wherein said glass includes a passage for a winder shaft aligned with said winder shaft passage in said dial.

14. A wrist watch according to claim 13 wherein said middle portion has a non-uniform thickness.

15. A wrist watch according to claim 1 wherein said glass comprises a cover glass having at least two moldings for connection to said connection means.

16. A wrist watch according to claim 15 wherein said cover glass includes a transparent portion and an opaque portion.

17. A wrist watch according to claim 1 wherein said dial includes at least two moldings for connection to said connections means.

* * * * *